US006328360B1

(12) United States Patent
Freeman

(10) Patent No.: US 6,328,360 B1
(45) Date of Patent: Dec. 11, 2001

(54) CHOPSTICK SET

(76) Inventor: Roger Freeman, P.O. Box 260376, Encino, CA (US) 91426

( * ) Notice: Subject to any disclaimer, the term of this patent is extended or adjusted under 35 U.S.C. 154(b) by 0 days.

(21) Appl. No.: 09/507,754

(22) Filed: Feb. 18, 2000

Related U.S. Application Data

(60) Provisional application No. 60/121,409, filed on Feb. 22, 1999.

(51) Int. Cl.[7] ..... A47G 21/10

(52) U.S. Cl. ..... 294/1.1; 206/553

(58) Field of Search ..... 294/1.1, 5.5, 61, 294/99.2; 30/123, 124, 142, 150, 322, 324, 329, 340; 206/223, 372, 374, 549, 553; D7/642, 643, 664

(56) References Cited

U.S. PATENT DOCUMENTS

| | | | | |
|---|---|---|---|---|
| 4,940,143 | * | 7/1990 | Stanfield | 206/553 |
| 5,431,465 | * | 7/1995 | Shibata | 294/1.1 |
| 5,727,677 | * | 3/1998 | Peviani | 206/553 X |

FOREIGN PATENT DOCUMENTS

| | | | | |
|---|---|---|---|---|
| 2060303 | * | 7/1993 | (CA) | 294/1.1 |
| 2698772 | * | 6/1994 | (FR) | 294/1.1 |
| 161673 | * | 1/1989 | (JP) | 294/1.1 |
| 5908 | * | 2/1990 | (JP) | 294/1.1 |
| 215712 | * | 8/1992 | (JP) | 294/1.1 |
| 90845 | * | 4/1994 | (JP) | 294/1.1 |
| 121727 | * | 5/1994 | (JP) | 294/1.1 |

* cited by examiner

*Primary Examiner*—Johnny D. Cherry
(74) *Attorney, Agent, or Firm*—Roger A. Marrs

(57) ABSTRACT

A chopstick set includes two pairs of chopsticks with a single pair of interchangeable handles and with each pair being of a different configuration such as Chinese style and Japanese style. Each chopstick has a handle or holder portion detachably connected to a food engaging or gripping portion. The adjacent ends of the handle or holder portion and the food engaging or gripping portion are detachably joined together by an interference type fit connector. A hygienic and cleanable travel case is provided having a support or insert with channels shaped to receive and store the pairs of chopsticks when disassembled. A sanitizer may be carried in the case.

1 Claim, 1 Drawing Sheet

10
11
11'
12
13
14
15
15'
16
17
18
20
21
22
22'
23
24
25
26
27
30
31
32
33
3
4
5

CHOPSTICK SET

Priority claimed on Ser. No. 60/121,409 filed Feb. 22, 1999.

BACKGROUND OF THE INVENTION

1. Field of the Invention

The present invention relates to the field of culinary implements, and more particularly to a novel set of chopsticks which incorporate an interchangeable handle and which provides for a variety of stick cross-sections suitable for grasping a variety of Asian foods. A kit is also included for transporting disassembled chopsticks in a sanitary manner so that the chopsticks and case can be sanitized and are personalized and ready for reuse.

2. Brief Description of the Prior Art

In the past, it has been the conventional practice to grasp a variety of Asian foods by the use of elongated chopsticks. The chopsticks are used in pairs and manipulated by the fingers of one hand to grasp the food and to carry the food from a dish to the mouth of the consumer. Each stick of the pair is elongated and is of a one-piece unitary construction, having a thickness at one end and a reduced thickness at the opposite end. The thickened end is held usually between the thumb and index finger of the user while the thinner elongated portion of the stick outwardly extends from the hand. In some Asian restaurants, a pair of chopsticks is provided at each place setting for the consumer to use. After the meal, the chopsticks are generally cleansed for reuse or in some instances, the chopsticks are destroyed or otherwise disposed of. Problems and difficulties have been encountered with such conventional practice in that sometimes the chopsticks are not thoroughly sanitized so that a danger resides in reuse. In other instances, the consumer may wish to use his own personalized chopsticks and to carry these sticks to a restaurant where he intends to order food. However, maintaining the sticks sanitary is difficult and because of the overall length of the sticks, carrying the sticks in a shirt pocket or coat pocket is not always convenient.

Therefore, a long-standing need has existed to provide a pair of chopsticks wherein each stick can be disassembled into separate parts and wherein the individual parts of the sticks can be carried in a case or kit for transport from one place to another in a sanitary fashion. Also, it is of great convenience to provide different shapes or sizes of chopsticks so that Particular Asian food can be grasped conveniently and in accordance with certain national customs.

SUMMARY OF THE INVENTION

Accordingly, the above problems and difficulties are avoided by the present invention which provides a novel set of chopsticks wherein each stick includes an interchangeably handle which is detachably connected to a food-engaging portion. The handle portion is provided with a deep recess at one end in order to insertably receive a stub outwardly projecting from one end of the eating portion of the stick. The opposite end includes a tapered portion which terminates in a rounded end that is intended to cooperate with the tapered and rounded end of the other stick in order to grasp and hold particles of food. Preferably, the stub and the recess include corresponding configurations so that the stub may be readily indexed with the recess and an interference type fit ensues for retaining the holder to the length of stick. In an alternate form, the stub may be threaded or have a keyway which is matable with the recess in the end of the holder.

The invention further contemplates two sets of chopsticks with interchangeable holders and wherein each set is different in that the thickness or cross-section of each pair of sticks is different in order to accommodate gripping or grasping of a variety of food products. A carrying case is also contemplated which includes a recessed insert so that the various portions and parts of the pair of chopsticks can be placed into recessed areas having the shape of the chopstick portion intended to be stored therein. The case is to be heat resistant and cleanable. A sanitizing substance may be carried in the insert material so that the chopstick utensils are ready for use upon removal from the case and assembly or installation of the holders on the eating portion of the stick.

Therefore, it is among the primary objects of the present invention to provide a novel pair of chopsticks which includes an interchangeable handle and which may readily be included in a set of chopsticks and carried in a suitable carrying case for sanitary purposes.

Another object of the present invention is to provide a novel set of chopsticks which will permit the user's choice of assembly in order to grasp or grip different types or styles of food products.

Another object of the present invention is to provide a novel set of chopsticks which includes a detachable handle portion and which includes an interference type of fit with one end of an elongated eating or grip portion.

Yet another object of the present invention is to provide a chopstick kit having a hygienic, cleanable and sanitary case for temporarily storing several sets of chopsticks such that the chopsticks are personalized and are intended to be used only by one person.

A further object is to provide a carrying case for eating utensils that is heat resistant, sanitary and cleanable as well as convenient to use, reusable and portable.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENTS

Figures 1, 2, 3, 4, 5, 6, 7, 8, 9:
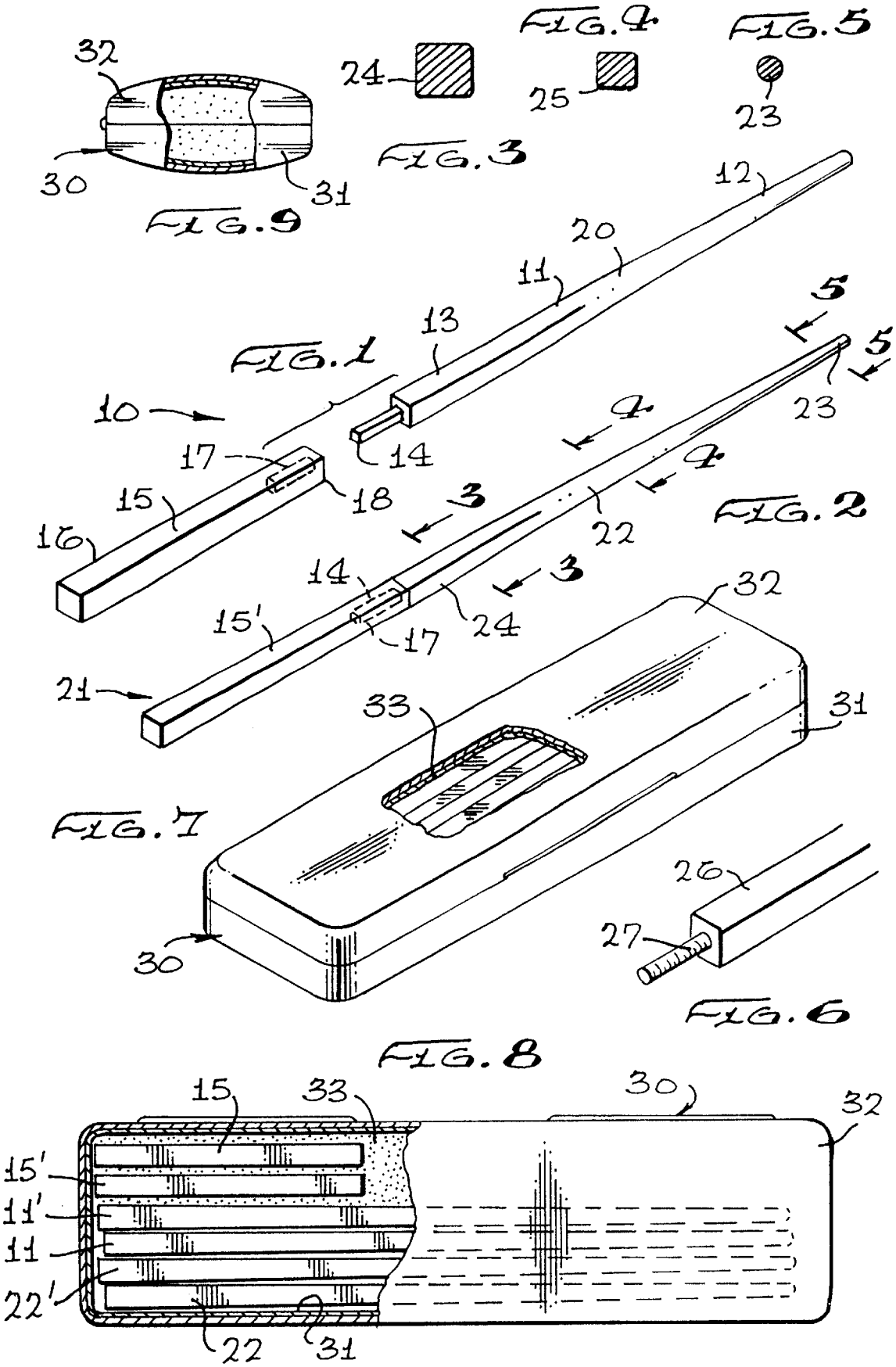
FIG. 1 is an exploded perspective view of a single chopstick of a pair incorporating the present invention.
FIG. 2 is a perspective view of a single chopstick of a pair illustrating another version.
FIGS. 3–5 are transverse cross-sectional views of the chopstick shown in FIG. 2.
FIG. 6 is a fragmentary perspective view of another attachment means for detachably connecting the components of a chopstick such as shown in FIG. 1 or 2.
FIG. 7 is a perspective view of a carrying case for two pairs of chopsticks.
FIG. 8 is a top plan view of the case shown in FIG. 7 having a portion broken away illustrating storage of the chopstick components.
FIG. 9 is an end view of the case shown in FIGS. 7 and 8.

Referring to FIG. 1, a novel chopstick eating utensil is illustrated in the general direction of arrow 10 which is of two-piece construction having an elongated member 11 terminating at one end in a rounded tip 12 which is intended to engage portions of food. The opposite end of member 11 is of square cross-section and is indicated by numeral 13. Outwardly projecting from the square end 13 is a stud 14 which is of a special configuration. It can be seen that the major length of the elongated member 11 is tapered from the square end 13 to the rounded end 12 and the external surface of the tapered portion is smooth and unadorned.

The chopstick 10 further includes a detachable handle or holder 15 which is of square cross-section and includes a free end 16 constituting the extreme end of the chopstick when the holder 15 is engaged with end 13 of member 11. Engagement occurs when the stud 14 is inserted into a receiving recess 17 provided in the end of holder 15 broadly identified by numeral 18. Preferably, the shape of recess 17 is such that it will insertably receive the special shape of the stud 14. The recess 17 in the holder 15 is of lesser or smaller dimension than the overall cross-section of end 13 or end 18 so that when the stud is inserted into the recess, a smooth and continuous surface is provided on all four sides of the assembled chopstick 10. The midsection of member 11 integrally joining end 13 with end 12 is of tapered circular configuration as the center section merges between the two ends.

Another version of the present invention is illustrated in the general direction of arrow 21 and is a chopstick having an identical holder 15'; however, the elongated food particle engaging member which is assembled to the end of the holder 15' is of a different configuration from the configuration of member 11 and the chopstick 21 configuration is indicated by numeral 22. This configuration is substantially tapered at a greater angle than that shown for member 11. The member 22 terminates in a rounded tip or end 23 while the opposite end is of square cross-section and indicated by numeral 24. End 24 includes the projection 14 which is insertably received within the recess 17 in the end of holder 15'. Again, it is noted that when the holder 15' is assembled with the member 22, a smooth and mating surface occurs on the exterior surfaces of both the holder and the member 22. To further illustrate the configuration of member 22, it can be seen that FIG. 3 is a square cross-section at one end 24 of member 22 while the midsection is indicated by numeral 25 and the rounded tip is indicated by numeral 23 in FIG. 5.

It is to be understood that the chopsticks 10 and 21 are used in separate pairs. For example, two chopsticks of the configuration shown in FIG. 1 are used in tandem for gripping and transporting food from a plate to the mouth of a consumer. With respect to chopstick 21, it is to be understood that a pair of such sticks are used as shown in FIG. 2 and that the pair of chopsticks 21 are used for the same purpose. For example, a pair of sticks having the configuration shown in FIG. 1 may be referred to as "Chinese" chopsticks while a pair of chopsticks indicated by numeral 21 may be referred to as "Japanese" chopsticks.

As illustrated in FIG. 6, an alternate fastening means for joining the opposite ends of holder 15 with the elongated members 11 or 22 is indicated and the elongated member is number 26 having a stud which is threaded, as indicated by numeral 27. The threaded stud is threadably engageable with internal threads in the recess 14 so that the respective pieces are screwed together to effect assembly and securement. It is to be understood that other types of securement means may be provided to join holders 15 to either of the respective chopstick members 11 or 22.

It is intended that pairs of the respective chopsticks 10 and 21 are to be personalized and used repeatedly by the same person and that the pairs of chopsticks may be carried from place to place in a sanitary environment and condition.

Referring now to FIGS. 7, 8 and 9, a sanitary case is illustrated in the general direction of arrow 30 which is used to carry two pairs of chopsticks from place to place. The case includes a body 31 with a hinged lid 32 and the body 31 includes an insert of solid or foam-like material 33 that is preformed with elongated recesses to hold the respective components of the pairs of chopsticks. For example, in FIG. 8 it can be seen that the holders 15 for each of the pair of chopsticks is stored in a recess having the same shape as the holders. The two holders are indicated by numeral 15 and 15' respectively. In parallel spaced-apart relationship with the holders, there are provided two pairs of elongated members, indicated by numeral 11 and 11' as shown in FIG. 1 and numerals 22' and 22. For the holders 15 and 15', the pairs of members are placed in corresponding recesses so as to lie in parallel spaced-apart relationship in the insert 33. Preferably, the insert or material 33 may be employed to hold sanitary solution or other medium which would be effective to maintain the pairs of chopsticks and holders sanitary. In this configuration, a kit is provided and the kit may be easily carried in a coat pocket, a purse or other garments worn by the user.

It is to be understood that the set of chopsticks includes at least two pairs and further includes a single set or pair of interchangeable handles which may be used for either pair of chopsticks in the set. The carrying or travel case is fabricated of materials that are heat resistant and readily cleansed so that the case is sanitary-independent of any embedded chemicals or separately included materials. The use of the chopsticks, per se, or in the carrying case are convenient, reusable and portable.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A chopstick set comprising:

a pair of chopsticks;

each chopstick of said pair having an interchangeable holder portion and a food engaging portion;

said holder portion being elongated of square cross-section and having opposite ends of which a selected end has a square open receptacle;

said food engaging portion being elongated of greater length than said holder portion and having opposite ends of which one end is rounded and the other end is a flat end and with an outwardly projecting stud carried on said flat end;

said stud being insertably receivable into said receptacle in an interference fit;

said holder portion includes a continuous square cross-section along its entire length;

said food engaging portion includes a first segment of square cross-section and a second segment of round cross-section terminating in a round tip;

said food engaging portion having a converging tapered surface extending from said first segment to said round tip of said second segment;

a carrying case having a bottom portion with a continuous sidewall defining an internal cavity and a closable lid hingably connected to said sidewall of said bottom portion;

a support occupying said cavity of said bottom portion and having a plurality of open channels;

each of said channels corresponding in shape and size to said holder portions and said food engaging portions;

an additional pair of chopsticks is provided with each chopstick of said pair having an interchangeable holder portion and a food engaging portion;

said support having said channels for receiving and storing both pairs of said chopsticks;

said support includes a sanitary means for maintaining said pairs of chopsticks in a sanitary state;

one pair of said chopsticks is configured to conform in size and shape to a Chinese style of chopstick having a 0.36° taper; and one pair of said chopsticks is configured to conform in size and shape to a Japanese style of chopstick having a 0.52° taper.

* * * * *